US011585046B2

(12) United States Patent
Jännetyinen

(10) Patent No.: US 11,585,046 B2
(45) Date of Patent: Feb. 21, 2023

(54) BELT INSTALLATION DEVICE

(71) Applicant: Valmet Technologies Oy, Espoo (FI)

(72) Inventor: Jari Jännetyinen, Sastamala (FI)

(73) Assignee: Valmet Technologies Oy, Espoo (FI)

( * ) Notice: Subject to any disclaimer, the term of this patent is extended or adjusted under 35 U.S.C. 154(b) by 315 days.

(21) Appl. No.: 16/907,038

(22) Filed: Jun. 19, 2020

(65) Prior Publication Data

US 2020/0400220 A1 Dec. 24, 2020

(30) Foreign Application Priority Data

Jun. 20, 2019 (FI) ..... 20195551

(51) Int. Cl.
*D21F 7/00* (2006.01)

(52) U.S. Cl.
CPC ..... *D21F 7/001* (2013.01)

(58) Field of Classification Search
CPC . D21F 7/001; D21F 7/005; D21F 1/10; D21F 7/00; B65G 15/30; B65G 17/30; B65G 49/00; B65G 49/05; B65G 2812/02; B65G 2812/02128; B65G 2812/02336; F16G 3/00; F16G 3/14; F16G 3/16
See application file for complete search history.

(56) References Cited

U.S. PATENT DOCUMENTS

| | | | | |
|---|---|---|---|---|
| 5,306,393 | A | 4/1994 | Rhyne | |
| 2004/0094280 | A1 | 5/2004 | Gardner et al. | |
| 2006/0137845 | A1 | 6/2006 | Ogiwara | |
| 2006/0180290 | A1 * | 8/2006 | Ogiwara | D21G 9/0072 162/273 |
| 2020/0109513 | A1 | 4/2020 | Kallenberg | |

OTHER PUBLICATIONS

Finnish Search Report for FI20195551, dated Jan. 3, 2020.

* cited by examiner

*Primary Examiner* — Eric Hug
*Assistant Examiner* — Matthew M Eslami
(74) *Attorney, Agent, or Firm* — Stiennon & Stiennon

(57) ABSTRACT

A belt installation device for installing a belt onto a paper machine, pulp machine or board machine, has a first area (4) with an attaching point (5) for attaching the belt installation device to a pulling member, a second area (6) with at least one aperture (7, 7*a*, 7*b*, 7*c*, 7*d*) for fastening the belt installation device (1) removably to a belt, and a central area (8) between the first area (4) and the second area (6), wherein a pull strength of the attaching point is at least 300 kgf and equal or less than 900 kgf. The belt installation device is bendable between a straight form and a curved form having a radius of curvature of 800 mm. This invention further relates to an installation arrangement and installing method for installing a belt onto a paper, pulp or board machine.

14 Claims, 7 Drawing Sheets

BELT INSTALLATION DEVICE

CROSS REFERENCES TO RELATED APPLICATIONS

This application claims priority on FI20195551 filed on Jun. 20, 2019 the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a belt installation device. This invention further relates to an installation arrangement for a belt. The invention further relates to an installation method for installing a belt onto a paper, board, or pulp machine.

Paper machines, as well as pulp and board machines, are typically equipped with a wire, a press section and a drying section to remove moisture from a fiber web. In paper, pulp and board making, it is an issue how to increase the dewatering amount from wet fiber web, in order to improve a production efficiency. Nowadays, these machines typically have belts and wires to remove water from the fiber web.

Each belt and wire used at a paper, board, and pulp machine must be changed time by time due to different kinds of reasons. Typically, an installation process of a new belt includes pulling the belt to be installed onto a predetermined location of a machine by using pull ropes. However, this installation process has some major disadvantages, such as possibility of damaging the belt to be installed. Moreover, safeness of individuals installing the belt cannot always be guaranteed if the belt is damaged during the installation process.

SUMMARY OF THE INVENTION

The present invention discloses a novel belt installation device. Further, the present invention discloses a novel installation arrangement for a belt, and a novel use of a belt installation device. Further, the present invention discloses a novel installation method for installing a belt onto a paper, board, or pulp machine.

The object of the present invention is to provide an improved belt installation device, an installation arrangement, and an installation method.

A belt suitable for a paper, pulp or board machine can comprise a plurality of attaching points of the belt, such as apertures.

A belt installation device for installing a belt onto a paper machine, pulp machine or board machine can comprise a first area comprising an attaching point for attaching the belt installation device to a pull rope, a second area comprising at least one aperture for removably fastening the belt installation device to a belt, and a central area between the first area and the second area.

The belt installation device can be bendable between a straight form and a curved form. The curved form refers to a bended shape having a radius of curvature of 800 mm or less, thus, the belt installation device can be bendable between a straight form and a curved form having a radius of curvature of 800 mm. Preferably, the belt installation device can be bend in a width direction to any radius of curvature between 200 mm and 800 mm and, more preferably, to any radius of curvature between 150 mm and 800 mm. Advantageously, the belt installation device is bendable in a width direction (1*w*) between a straight form and a curved form having any radius of curvature from 100 mm to said straight form. Thus, the belt installation device can be used with many kinds of belts having different diameters. Furthermore, the bendable belt installation device is capable of being bent at least to said radius of curvature without breaking, hence, the belt installation device may not be easily damaged.

A pull strength of the attaching point of the belt installation device can be at least 300 kgf (corresponding to at least 2940 N), more preferably at least 350 kgf, and most preferably at least 400 kgf, such as between 350 kgf and 800 kgf. Thus, the belt installation device can be strong enough to be used for the belt installation process. Furthermore, the pull strength of the attaching point of the belt installation device can be equal or less than 900 kgf (corresponding to equal to or less than 8830 N), more preferably equal or less than 800 kgf, and most preferably equal or less than 700 kgf, for example between 400 and 600 kgf. Thus, the belt installation device can be used to protect the belt to be installed from a damage.

If the belt is damaged during an installation process, the belt may need to be removed from the machine. Therefore, another belt needs to be installed in its place. This is very time-consuming procedure, hence, improper installation may result in additional machine downtime. Furthermore, the belt itself is typically very expensive. Moreover, safeness of individuals cannot always be guaranteed if the belt is damaged during the installation process.

Thanks to the novel solution, the belt installation device can be configured to break the attaching point of the belt installation device if a pulling force of the pull rope is increased over a predetermined value, for example due to problems during the installation process of the belt. Thus, the belt installation device can prevent damage of the belt during an installation process. This will decrease costs because the belt installation device is not as expensive as the belt. Furthermore, an additional machine downtime may not be required, because the belt installation device may be changed into a new one fast.

Furthermore, the novel arrangement comprising the belt installation device and belt attaching means can have better strength properties than one attaching point of the belt. Thus, the novel arrangement may not be as easily damaged as the attaching point of the belt could be without the novel arrangement.

Furthermore, the belt installation device can ensure substantially uniform tension for the attaching points on the belt, apertures may be used as the attachment points. Thus the maximum pulling force affecting to any of the attaching points of the belt during the installation process can be decreased.

An installing method for installing a belt onto a paper, pulp, or board machine can comprise the following steps: providing a belt having at least one attaching point in a form of an aperture, providing a belt installation device having a first area comprising an attaching point for attaching the belt installation device to a pulling member, such as a pull rope, and a second area comprising at least one aperture for fastening the belt installation device removably to the at least one attaching point of the belt, and a central area between the first area and the second area, securing the belt to the second area of the belt installation device by using said at least one aperture of the second area of the belt installation device, securing the pulling member to the attaching point of the first area of the belt installation device, and pulling the pulling member in a given direction in order to install the belt onto a predetermined location of the paper, pulp, or board machine, wherein if a pulling force of the pulling member increases over a predetermined value, the method further comprises breaking the attaching point of the first area of the belt installation device to minimize damages of the belt.

Thus, the attaching point of the first area of the belt installation device can break if the pulling force is too high, i.e., the attaching point will be broken before too high pulling force would break the belt. The predetermined value, in which the attaching point breaks, is the pull strength of the attaching point of the belt installation device, hence, it is preferably in a range between 300 kgf and 900 kgf, more preferably at least 400 kgf and equal or less than 700 kgf.

The attaching point of the first area of the belt installation device can comprise an aperture. In an embodiment, the attaching point of the first area comprises two apertures. However, preferably the attaching point of the first area of the belt installation device comprises exactly one aperture.

The second area of the belt installation device can comprise at least two apertures. The belt can be secured more firmly by using more than one or two apertures for the second area of the belt installation device. However, the usage of the belt installation device can be more challenging if there are too many apertures in the second area of the belt installation device. Thus, preferably the second area of the belt installation device comprises from three to six apertures, most preferably four or six apertures. By using a suitable, even number of apertures of the second area of the belt installation device, the strength properties as well as stability during the installation process can be improved.

A length of the belt installation device can be in a range of 150-400 mm. Furthermore, a thickness of the belt installation device can be at least 4 mm and equal or less than 40 mm. Furthermore, a width of the belt installation device, determined on the widest part of the belt installation device can be in a range of 150-550 mm. Furthermore, a width of the first area of the belt installation device, determined via the attaching point of the first area of the belt installation device, can be in a range of 15-200 mm. By using the above-mentioned dimensions, the belt installation device can be easy to use, and controllability of the installation process can be improved.

The belt installation device can comprise at least one layer, for example from two to four layers. Preferably, the belt installation device comprises or consists of two layers, i.e., a first layer of the belt installation device and a second layer of the belt installation device. In this case, the first layer and the second layer of the belt installation can be attached to each other at least partially on the central area, preferably by using internal attaching means. This can improve a stability of the belt installation device and, moreover, the belt to be installed can be secured between said layers.

The internal attaching means can comprise of a at least one of: an adhesive, a cable tie, a rope, metal clip(s), and polymer clip(s). In addition, or alternatively, the first layer and second layer can be attached to each other by melting at least partly the surfaces of said layers facing each other, and/or vulcanizing said layers. The belt installation device can comprise or consist of at least one of: polyamide, polyester, polyethylene, silicone, polyurethane, natural rubber (NR), synthetic rubber (SR), polytetrafluoroethylene (PTFE). The amount of said materials being preferably at least 50 wt. %, calculated of total weight of the belt installation device.

Preferably, the belt installation device comprises polyurethane, the amount of the polyurethane being preferably at least 50 wt. %. Most preferably, the amount of the polyurethane is at least 70 wt. %, calculated of total weight of the belt installation device. Thus, the strength properties as well as elasticity and bendability of the belt installation device can be improved.

A width of at least one aperture, more preferably at least two, three or four apertures, and most preferably all apertures of the second area of the belt installation device, can be in a range of 10-40 mm. Furthermore, a length of at least one aperture, more preferably at least two, three or four apertures, and most preferably all apertures of the second area of the belt installation device, can be in a range of 10-18 mm. By using said dimensions for the aperture(s) of the second area of the belt installation device, the belt can be firmly secured to the belt installation device.

Furthermore, at least one aperture, more preferably at least two apertures of the second area of the belt installation device can have a width, which width is at least 1.3 times a length of the same aperture, preferably from 1.3 times to 4.0 times the length of the same aperture. Thus, the belt installation device can be used with different kinds of belts having differently spaced attaching points.

Furthermore, a width of the centermost aperture(s) of the second area can be smaller than a width of at least one another aperture of the second area of the belt installing device. In an embodiment, the width of the centermost aperture(s) is from 0.2 to 1.0 times a length of at least one another aperture of the second area of the installation device, preferably from 0.3 to 0.8 times the length of the at least one another aperture of the second area of the installation device. Thus, the belt installation device can be used with different kinds of belts having differently spaced attaching points and still the belt to be installed can be secured firmly to the belt installation device.

During the installation process, at least one belt installation device can be used to install one belt. Advantageously, at least two belt installation devices are used for the installation method to install one belt, such as from two to four, more preferably from two to three belt installation devices, and most preferably exactly two belt installation devices.

The belt installation device according to the present invention can be removably attached to a belt, hence, one belt installation device can be used to install several belts on paper machines, board machines and/or pulp machines.

The belt installation device is preferably attached to the attaching point(s) of a belt at the mill side. However, it is possible to attach the belt installation device to the belt at a factory, before the belt is transported to the paper, pulp or board mill.

Thanks to the novel solution, the novel belt installation device can be used with different kinds of belts having different diameters. Furthermore, the novel belt installation device is bendable, i.e., it can, without breaking, bend to the same radius of curvature as the belt it is used for.

BRIEF DESCRIPTION OF THE DRAWINGS

In the following, the invention will be illustrated by drawings in which.

Figures are schematic. Similar parts are indicated in the figures by the same reference numbers.

DESCRIPTION OF THE PREFERRED EMBODIMENTS

All embodiments in this application are presented as illustrative examples, and they should not be considered limiting.

The following reference numbers are used in this application:

1 belt installation device,
1*a* first layer of the belt installation device,
1*b* second layer of the belt installation device,
It thickness of the belt installation device,
1*w* width of the belt installation device,
1*h* length of the belt installation device,
1*c* centerline of the belt installation device,
2 belt attaching means, such as a fastening rope,
3 internal attaching means of the belt installation device,
4 first area of the belt installation device,
4*w* width of the first area of the belt installation device,
5 attaching point of the first area of the belt installation device, such as an aperture,
5*a* attaching point of the first area of the belt installation device in a form of an aperture,
5D diameter of the attaching point of the first area of the belt installation device,
6 second area of the belt installation device,
6*w* width of the second area of the belt installation device,
7 aperture(s) of the second area of the belt installation device,
7*h* length of the aperture of the second area,
7*w* width of the aperture of the second area
7*a* first aperture of the second area of the belt installation device, centermost aperture of the second area
7*b* second aperture of the second area of the belt installation device,
7*c* third aperture of the second area of the belt installation device,
7*d* fourth aperture of the second area of the belt installation device,
8 central area of the belt installation device,
8*a* aperture of the central area of the belt installation device,
10 belt, 10*a* attaching point of the belt, such as an aperture,
$\alpha$1, $\alpha$2, $\beta$ angle between two main sides of the belt installation device, and
F1 pulling force.

In this application, the term "belt" refers to a belt which is suitable for a paper, pulp, or a board machine. The belt 10 is typically shaped like an endless loop. The belt 10 typically comprises an elastomeric frame, hence, it can have a sufficient elasticity, i.e., an ability to return to its original shape after pressing. The belt 10 can be used, for example, for removing water from a fiber web. The belt 10 can be arranged in different places at a paper, pulp, or board mill. In an embodiment, the belt 10 is installed on to a shoe press of a paper machine.

In this application, the term "belt installation device" refers to a device, which can be used for installing the belt 10 onto a predetermined location in a paper, pulp or a board machine. Typically, the belt installation device 1 is used to pull the belt 10 onto said predetermined location.

Figure 5:
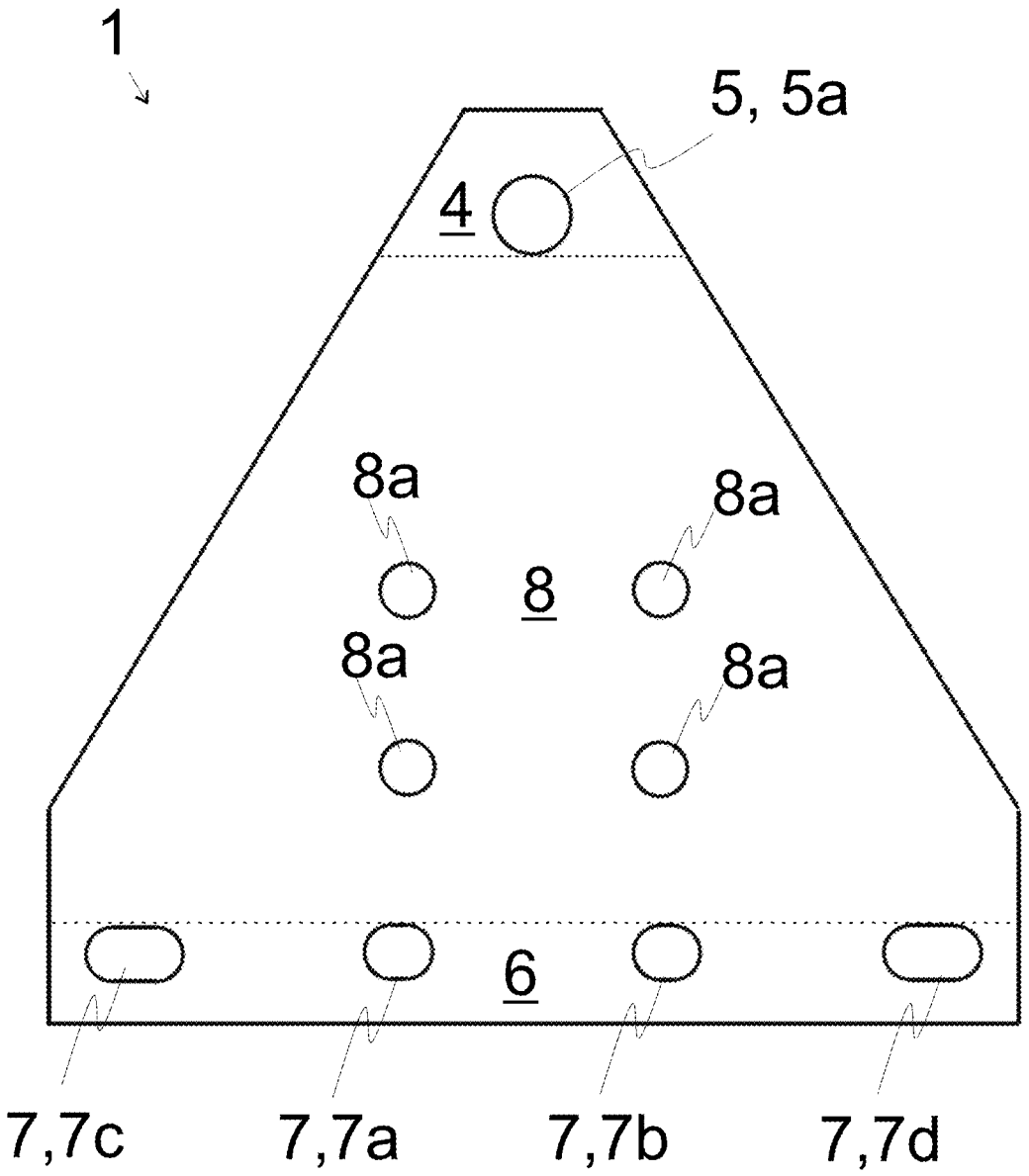
FIG. 5 illustrates a belt installation device, examined in a first direction.
Figure 5:
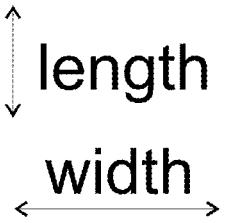

As shown in FIG. 5, the belt installation device 1 can have a planar or substantially planar surface and has a body having a first segment or area 4, a second segment or area 6, and a central segment or area 8 at least partly between the first area and the second area of the belt installation device, when examined in a first direction. In this application, the term "first area of the belt installation device" refers to a certain part of the belt installation device 1, which part is the frontmost part of the belt installation device when the belt is pulled onto the predetermined location. The first area 4 of the belt installation device 1 comprises the attaching point 5 of the first area 4 of the belt installation device 1.

In this application, the term "second area of the belt installation device" refers to a certain part of the belt installation device, which part is the rearmost part of the belt installation device 1 during the installation process, in which the belt is pulled onto the predetermined location. The second area 6 of the belt installation device 1 comprises aperture(s) 7, 7*a*, 7*b*, 7*c*, 7*d* of the second area 6 of the belt installation device 1.

In this application, the term "central area of the belt installation device" refers to a part 8 of the belt installation device, which is between the first area 4 of the belt installation device and the second area 6 of the belt installation device 1, i.e. between the aperture(s) 7 of the second area of the belt installation device and the attaching point 5 of the first area of the belt installation device.

In this application, the term "installation arrangement" refers to an arrangement comprising the belt installation device 1 and belt attachments 2, such as a fastening rope.

Figure 6A:
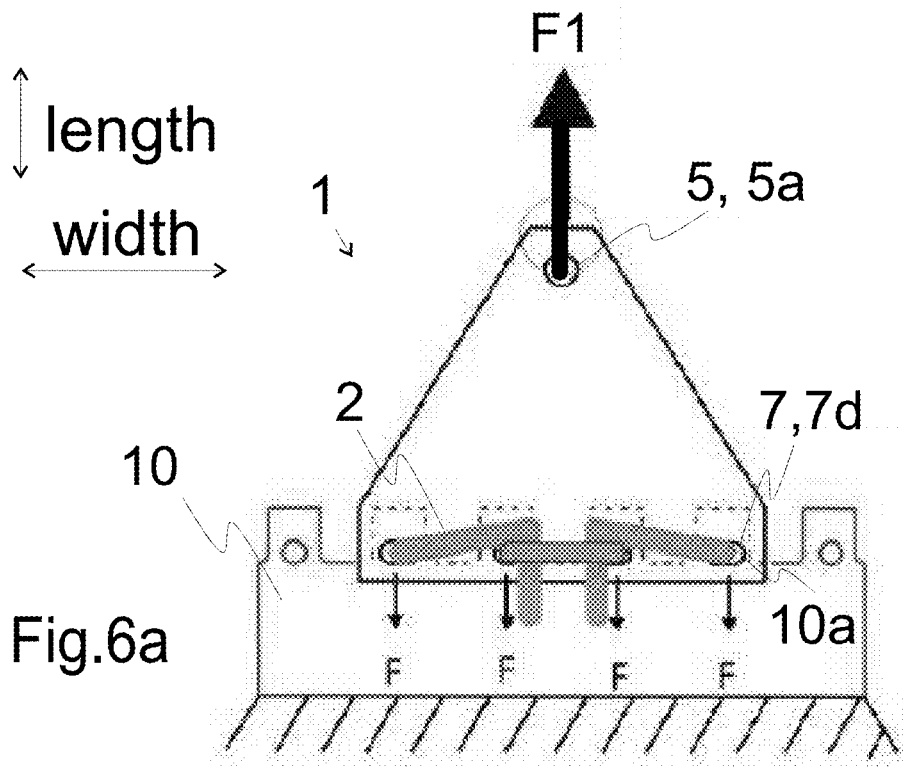
FIG. 6*a* illustrates a part of a belt and an arrangement comprising the belt installation device and belt attaching means, examined in a first direction.

A sacrificial part is apart of a machine or product that is intentionally engineered to fail under excess mechanical stress, electrical stress, or other unexpected and dangerous situations. The sacrificial part is engineered to fail first, and thus protect other parts of the system. The installation device has a sacrificial part which responds to excessive pulling force on the device which would be greater than the force which the belt being installed could handle. A pull strength of the attaching point 5, 5*a* of the first area of the belt installation device is determined by attaching a snap hook to the attaching point 5 of the belt installation device, and pulling the snap hook with a pulling force F1 while keeping the belt installation device firmly in a place by using apertures 7 of the second area of the belt installation device (shown in FIG. 6*a*). The pulling force F1 needs to be increased until the attaching point 5 of the first area of the belt installation device breaks. The snap hook, or at least the part of the snap hook touching the belt installation device 1 during the determination of the pull strength, has a width of 8 mm and is made of metal. The pull strength is determined at room temperature (23° C.). The pull strength of the attaching point 5, 5*a* of the first area of the belt installation device 1 is the pulling force (measured in kilograms (kgf)) in which the attaching point 5, 5*a* is broken, i.e. the pull strength is the pulling force F1 (measured in kilograms (kgf)) needed to break said attaching point 5. In other words, the pull strength of the attaching point 5 of the illustrated embodiment is the pulling force F1 (measured in kilograms (kgf)) in which the material of the first segment surrounding the aperture of the attaching point 5, 5*a* breaks. The device is thus constructed with the aperture positioned in the desired manner to achieve the desired selected pull strength.

The first layer 1*a* and the second layer 1*b* of the belt installation device are advantageously attached to each other partially during the installation process of the belt 10. The first layer 1*a* of the belt installation device and the second layer 1*b* of the belt installation device can be attached to each other on the central area 8 of the belt installation device. Most advantageously, the first layer 1*a* and the second layer 1*b* are not attached to each other on the second area 6 of the belt installation device. Thus, it is possible to fasten the belt 10 to be installed between said first layer 1*a* and said second layer 1*b* on the second area 6 of the belt installation device.

A centerline 1*c* of the belt installation device 1 is parallel to the length 1*h* and perpendicular to the width 1*w* of said belt installation device. In a case there is only one centermost aperture 7*a*, 7*b* of the second area 7, the centermost aperture 7*a*, 7*b* is preferably on the centerline 1*c*.

There is preferably two centermost apertures 7*a*, 7*b* of the second area 7, one on both sides of the centerline 1*c*, the centermost apertures 7*a*, 7*b* of the second area having a same or substantially same (i.e., ±10%, more preferably ±5%) distance to the centerline 1*c*. Therefore, a stability and strength properties of the belt installation device 1 can be improved. In other words, if the centermost aperture 7 of the second area is not on the centerline 1*c*, there is preferably two centermost apertures 7*a*, 7*b* of the second area 6 having the same distance to the centerline 1*c*. This can cause substantially uniform tension for the centermost apertures 7*a*, 7*b* of the second area during the installation process of a belt.

A total sum of distances, calculated as a sum of distances from a center of each aperture 7, 7*a*, 7*b*, 7*c*, 7*d* of the second area to the centerline 1*c*, can be equal or substantially equal (i.e. ±10%, more preferably ±5%) at both sides of the centerline 1*c*. Thus, each aperture 10*a* of the belt 10 attached to the belt installation device 1 can have substantially uniform tension.

The belt installation device can have an odd number of the apertures 7, 7*a*, 7*b*, 7*c*, 7*d* of the second area. However, in order to decrease a force affecting to the centermost aperture (s) of the second area, the belt installation device 1 preferably has an even number of the apertures 7, 7*a*, 7*b*, 7*c*, 7*d* of the second area.

In order to avoid or minimize damaging to the belt 10 during an installation process, a belt installation device 1 can be used to install said belt 10. The belt installation device 1 can be attached to attaching point(s) 10*a* of the belt 10.

Advantageously, the attaching points 10*a* of the belt are in the form of apertures. Further, each aperture of the belt installation device can be attached to one, different, attaching point of the belt so that each aperture 10*a* of the belt 10 used for pulling during the installation process has substantially uniform tension.

The belt installation device can be triangular, when examined in a first direction. By using the triangular form, a controllability of the belt installation device can be improved.

In this application, the "triangular form" means that the belt installation device can be a triangle, i.e., it can have three main sides and three angles between said main sides, when examining in a first direction, or it can have several angles but three main sides (shown in FIGS. 2-7), when examining in the first direction, the three main sides forming the triangular form of the belt installation device. Thus, even if the belt installation device may have several angles, the belt installation device preferably looks triangular when examined in a first direction. This is shown in FIGS. 2-7. In an advantageous embodiment, each angle $\alpha 1$, $\alpha 2$, $\beta$ (shown in FIG. 2) between two main sides is from 40° to 80°, more preferably between 50° and 70°, and most preferably between 55° and 65°. Total sum of said angles $\alpha 1+\alpha 2+\beta$ is preferably 180°, i.e., the interior angles of the triangular form add up to 180°. By using said angles between main sides of the belt installation device, the controllability of the belt installation device can be further improved.

The belt installation device 1 has a length 1*h*, width 1*w* and thickness it as shown in FIGS. 2-5. The length is parallel to a centerline 1*c*, and it can be determined from the frontmost side (which is the frontmost side of the belt installation device when the belt is pulled onto the predetermined location) to the rearmost side (which is the rearmost side of the belt installation device when the belt is pulled onto the predetermined location). The thickness is the smallest dimension, perpendicular to the length. The width is perpendicular to the length and the thickness.

The length 1*h* of the belt installation device can be at least 150 mm, more preferably at least 200 mm, and most preferably at least 220 mm. In addition, the length 1*h* of the belt installation device can be equal or less than 500 mm, more preferably equal or less than 400 mm, and most preferably equal or less than 300 mm, for example equal or less than 250 mm. Thus, the belt installation device can be easily controlled and still has good strength properties. Furthermore, the belt installation device can be small enough to be used with conventional pulling member.

The width 1*w* of the belt installation device, determined on the widest part of the belt installation device, typically on the second area 6 of the belt installation device, can be at least 150 mm, more preferably at least 180 mm, and most preferably at least 200 mm. In addition, the width 1*w* of the belt installation device, determined on the widest part of the belt installing device, typically on the second area of the belt installation device 1 can be equal or less than 700 mm, more preferably equal or less than 550 mm, for example equal or less than 500 mm, and most preferably equal or less than 400 mm, for example equal or less than 300 mm. Thus, the belt installation device 1 can be easily controlled and still has good strength properties. Furthermore, a belt installation device having a quite small maximum width of equal or less than 550 mm, more preferably equal or less than 400 mm, can be easier to attach to the belt than wider belt installation devices.

Further, said suitable width together with said suitable length may improve the production efficiency of the belt installation device. In an advantageous embodiment, the length of the belt installation device is in a range of 150-400 mm, and the width 1*w* of the belt installation device, determined on the widest part of the belt installation device 1, is in a range of 150-550 mm.

To further improve the easiness of the installation process, the most suitable width, determined on the widest part of the belt installation device, and the most suitable length are both between 150 mm and 400 mm, more preferably between 200 mm and 300 mm.

A width of the first area 4 of the belt installation device, measured via a center of the attaching point 5 of the first area 4, can be substantially smaller than the width 1*w* determined on the widest part of the belt installation device. Furthermore, a width of the first area 4, measured via a center of the attaching point 5 of the first area 4, can be substantially smaller than a width of the second area 6, measured via a centermost aperture 7*a* of the second area 6.

A width of the first area of the belt installation device, measure via a center of the attaching point 5 of the first area, is preferably in a range of 15 and 200 mm, more preferably between 40 mm and 150 mm. The technical effect is, that the installing process is easier to control by using said width range of the first area and, furthermore, the belt installation device can have suitable strength properties.

In an advantageous embodiment, the width 4*w* of the first area 4 is at least 1.5 times smaller than the width of the second area 6, more preferably at least 2 times smaller than the width of the second area 6, and most preferably from three to ten times smaller than the width of the second area 6, measured via a centermost aperture of the second area 6. Thanks to said dimensions, wherein the width of the belt installation device 1 is smaller on the first area 4 of the belt installation device than on the second area 6 of the belt installation device, a belt can be easily installed, for example, the installing process of a belt can be easier to control than otherwise.

An average thickness 1*t* of the belt installation device can be at least 4 mm, more preferably at least 5 mm, and most preferably at least 7 mm, for example in a range of 7 mm-20 mm. Thus, the belt installation device can be strong enough to be used for the belt installation process. Furthermore, an average thickness of the belt installation device can be equal or less than 40 mm, more preferably equal or less than 20 mm, and most preferably equal or less than 15 mm. Thus, the belt installation device can be easily controlled. Furthermore, said thickness can improve production efficiency of the manufacturing process of the belt installation device.

By using the above-mentioned width and/or length and/or thickness of the belt installation device, most advantageously the above-mentioned width and length and thickness, the belt installation device can be easily controlled during the installation process. Therefore, the installation process can be efficiently done, hence, the total installation time may be decreased. Furthermore, the belt installation device having the above-mentioned dimensions can be manufactured efficiently having a good production efficiency.

The belt installation device 1 can be made of material(s) which do not harm the belt nor the paper, pulp or board machine during the installation process. The belt installation device 1 can comprise polymer(s). The belt installation device 1 can comprise or consist of polyamide, and/or
polyester, and/or
polyethylene, and/or
silicone, and/or
polyurethane, and/or
natural rubber (NR), and/or
synthetic rubber (SR), the amount of said materials being preferably at least 50 wt. %, more preferably at least 60 wt. %, and most preferably at least 70 wt. %, calculated of total weight of the belt installation device 1. These materials are advantageous for forming of the belt installation device 1. Thus, the belt installation device 1 can have suitable strength properties as well as be elastic enough to be able to bend during an installation of a belt without cracking.

Advantageously, the belt installation device 1 comprises polyurethane. The amount of the polyurethane is advantageously at least 50%, more preferably at least 70%, and most preferably at least 80%, calculated of total weight of the belt installation device 1. Polyurethane can improve elasticity and other properties of the belt installation device.

The belt installation device 1 can have a reinforcement structure. The reinforcement structure can be formed by woven reinforcement base fabric. This can improve strength properties of the belt installation device 1.

Advantageously, the attaching point 5 of the first area 4 of the installation device comprises or consists of an aperture. Therefore, the belt installation device 1 can be secured to pulling member, such as a pull rope, by using said aperture 5*a* of the first area 4 of the belt installation device 1.

In an advantageous embodiment, the belt installation device comprises at least two apertures 7, 7*a*, 7*b*, 7*c*, 7*d* of the second area of the belt installation device. In this case, the belt installation device 1 can be fastened to the belt 10 by using said at least two attaching points 10*a* of the belt 10. By using said at least two apertures, a pull strength of the attaching point 5 of the first area 4 of the belt installation device 1 can be at least 1.2 times, more preferably at least 1.5 times, and most preferably at least 1.6 times a strength affecting one attaching point 10*a* of the belt 10 of said belt installation device 1. Thus, the belt installation device 1, which is protecting the belt so that the belt installation device can be broken before the belt will get broken, may have better strength properties as one attaching point 10*a* of the belt 10.

An attaching point 5 of the first area 4 of the belt installation device 1 can handle at least 300 kgf pulling force (measured in kilograms), more preferably at least 350 kgf pulling force, and most preferably at least 400 kgf pulling force before the belt installation device 1 will be broken. In addition, the attaching point 5 of the first area 4 of the belt installation device 1 can preferably handle a pulling force of equal or less than 800 kgf (measured in kilograms), for example in a range of 350-800 kgf, before the attaching point 5 of the first area 4 of the belt installation device 1 is broken. The technical effect of said pulling force is that the belt installation device is strong enough to be used for the installation of the belt but at the same time the belt installation device is weaker than the belt to be installed so that the belt installation device will be broken before the belt will get broken. Thus, if there are any problems, the belt installation device 1 is protecting the belt, hence, the belt may not be harmed. In an advantageous embodiment, the pull strength of the attaching point 5 of the first area 4 of the belt installation device 1 is at least 300 kgf and equal or less than 200 kgf×number of those attaching points 10*a* of the belt 10 secured to said belt installation device 1.

Figure 1:
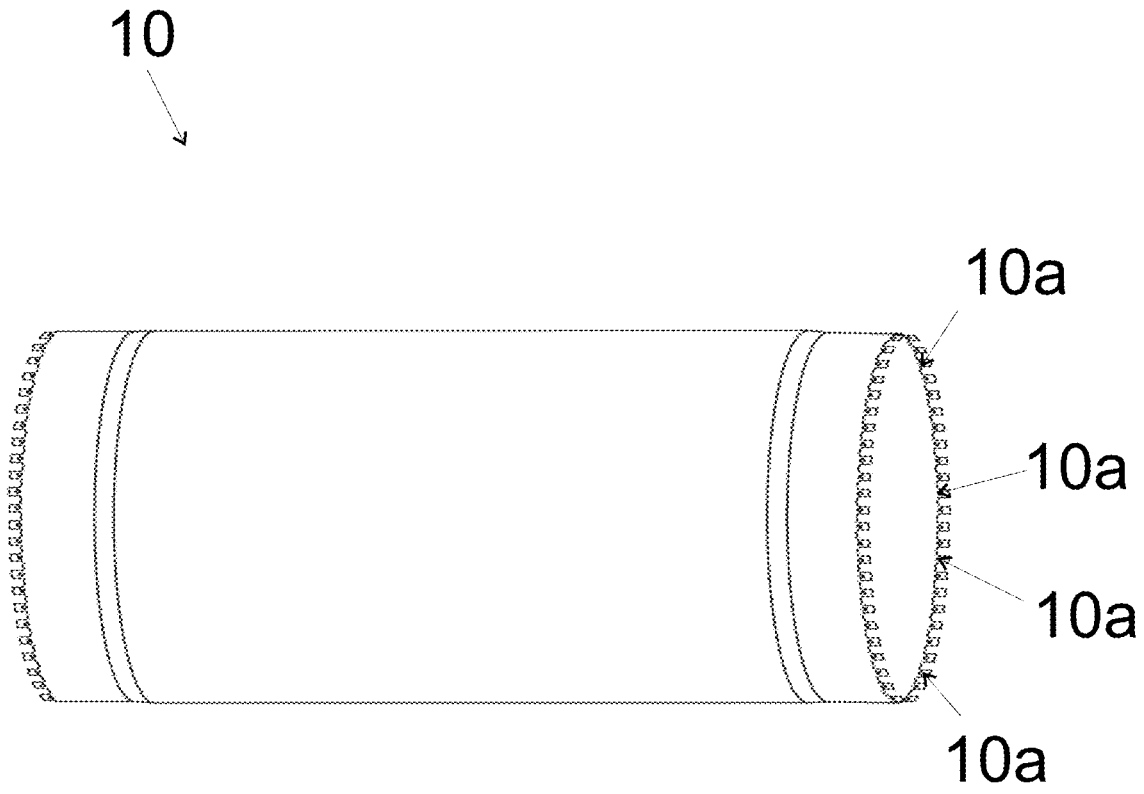
FIG. 1 illustrates a perspective view of a belt.
Figure 2:
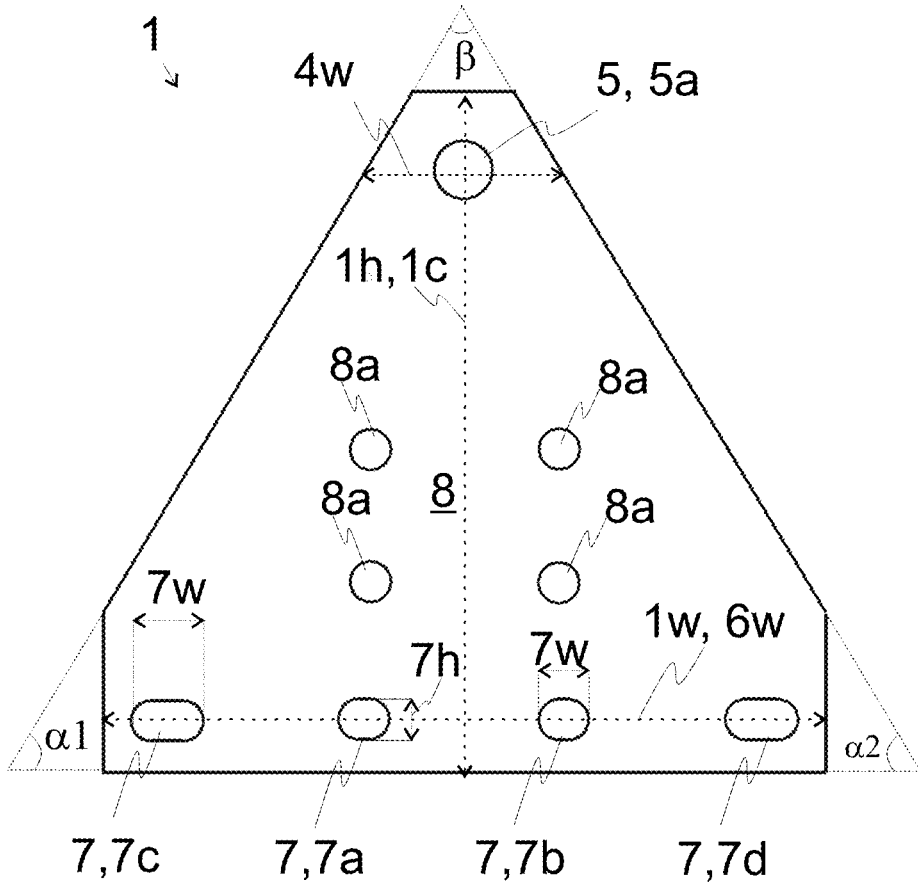
FIG. 2 illustrates a belt installation device, examined in a first direction.
Figure 2:
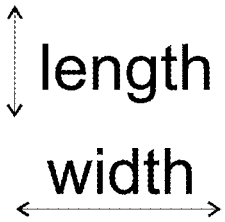

In an advantageous embodiment, wherein the attaching point 5 is an aperture, a center of the attaching point 5 can be from 18 mm to 50 mm, more preferably from 20 mm to 35 mm, and most preferably from 22 mm to 30 mm, determined from the nearest edge of the belt installation device in a length direction 1*h*. In this case, an average diameter 5D of the first attaching point 5 of the first area 4 of the belt installation device 1 (shown in FIGS. 3*b* and 4*a*) can be at least 10 mm, for example between 10 mm and 30 mm, preferably between 15 mm and 25 mm. Thus, the belt installation device can have good properties to be used together with a pull rope. Moreover, the installation process can be easily controlled. The aperture of the first area 4 is preferably on the centerline 1*c* of the belt installation device 1, as shown in FIG. 2. If the attaching point 5 comprises two apertures, the apertures may be on both sides of the centerline 1*c*.

The second area 6 of the belt installation device 1 can comprise at least one aperture 7. FIGS. 2 to 4*b* illustrate four apertures, but more apertures or less apertures may be used.

The second area 6 of the belt installation device 1 can comprise at least two apertures, for example from two to eight apertures, and more preferably at least 3 apertures, for example from three to five apertures, and most preferably at least 4 apertures, such as four or six apertures. Therefore, the belt 10 can be firmly secured to the belt installation device 1 by using said apertures of the second area.

Most advantageously, the belt is secured between the first layer 1*a* and the second layer 1*b* of the belt installation device by using the fastening means or rope 2. Thus, it is possible to secure the belt installation device 1 to the belt 10 firmly, hence, controllability of the belt installation device during the installation process can be improved.

Figure 4A:
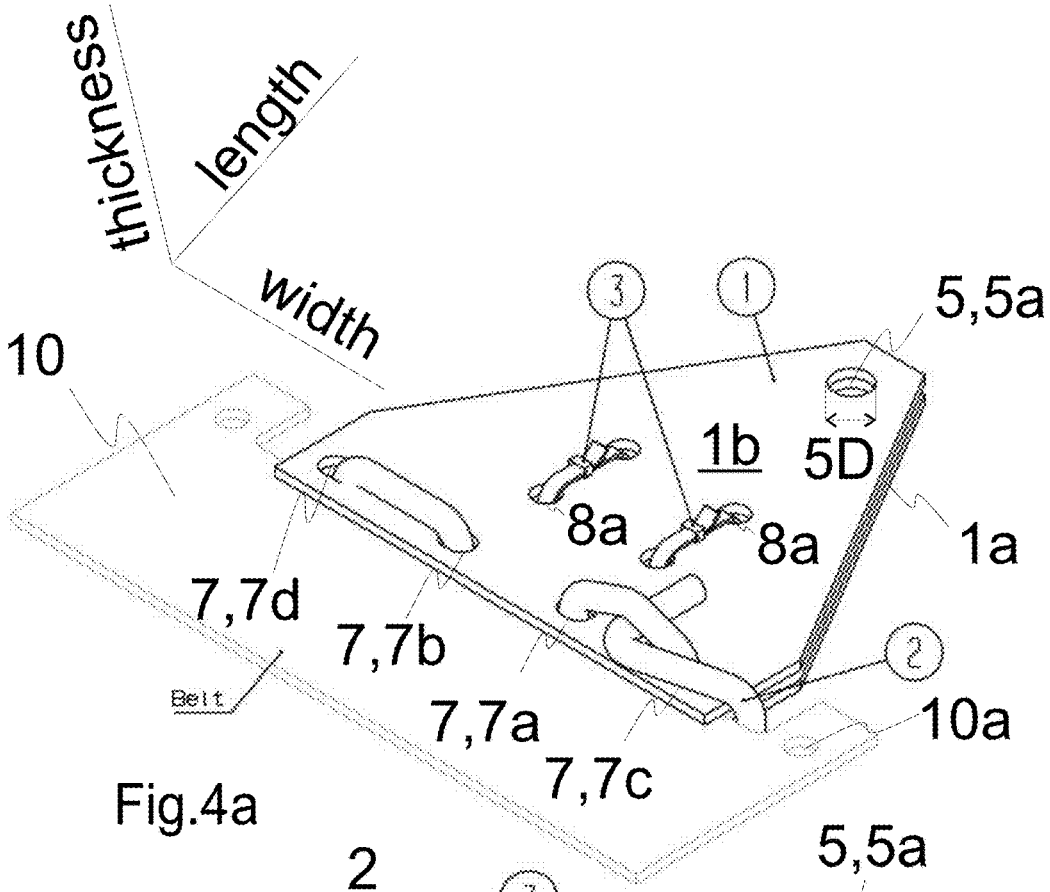
FIG. 4*a* illustrates a perspective view of an arrangement comprising the belt installation device and belt attaching means, showing the second layer of the belt installation device on top of the first layer.

Alternatively, the belt can be attached to the belt installation device by using the fastening means or rope 2 so that there is a space between the belt installation device 1 and the belt 10 to be installed. In this case, said space between the belt and the belt installation device is preferably less than 20 cm, more preferably equal or less than 10 cm, and most preferably equal or less than 5 cm. Therefore, it can be possible to use conventional pulling member together with the novel belt installation device. However, the controllability of the belt installation device may not be nearly as good as with the arrangement wherein the belt is secured between the first layer 1*a* and the second layer 1*b* of the belt installation device. Thus, most preferably, the belt is secured between the first layer 1*a* and the second layer 1*b* of the belt installation device as shown in FIGS. 4*a*; 4*b* and 6*b*.

A center of at least one aperture 7, 7*a*, 7*b*, 7*c*, 7*d* of the second area 6 of the belt installation device 1, most preferably a center of each aperture of the second area of the belt installation device, can be from 10 mm to 50 mm from the nearest edge of the belt installation device, more preferably in a range of 12-30 mm, and most preferably from 14 mm to 25 mm from the nearest edge of the belt installation device, measured in a length direction 1*h*. Thus, the belt installation device 1 can be fastened firmly to the belt 10.

The second area 6 of the belt installation device 1 can have more apertures than the first area 4 of the belt installation device, hence, the belt can be fastened to the belt installation device 1 firmly, decreasing a risk of the belt 10 to be damaged. Furthermore, the installation process can be easily controlled.

A length 7*h* of at least one aperture 7, more preferably at least two, or at least three apertures of the second area 6, and most preferably at least four or all apertures of the second area 6 of the belt installation device 1, can be at least 10 mm, for example between 10 mm and 18 mm, more preferably at least 11 mm, for example between 11 mm and 16 mm, and most preferably at least 12 mm or at least 13 mm, such as between 13 mm and 15 mm. The technical effect of said length of the aperture(s) 7 is that, by using said length, it is possible to attach the belt 10 to the belt installation device 1 firmly, for example, by using the fastening means 2 such as an installing rope. Furthermore, said length 7*h* of aperture(s) 7 can be effectively used together with attaching point(s) 10*a* of the belt 10.

A width 7*w* of at least aperture 7*a*, 7*b*, 7*c*, 7*d* of the second area 6 of the belt installation device 1, more preferably at least two, or at least three apertures of the second area 6, and most preferably at least four or all apertures of the second area 6 of the belt installation device 1, can be at least 10 mm, for example between 10 mm and 40 mm, more preferably at least 11 mm, for example between 11 mm and 35 mm, and most preferably at least 12 mm or at least 13 mm, for example between 13 mm and 30 mm. Therefore, it is possible to attach the belt to the belt installation device firmly, for example, by using an installing rope 2.

A width 7*w* of the centermost aperture(s) 7*a*, 7*b* of the second area 6 (shown in FIG. 2) can be equal or more than 10 mm, for example between 10 mm and 30 mm, more preferably at least 11 mm, for example between 11 mm and 20 mm, and most preferably at least 12 mm or at least 13 mm, for example between 12 mm and 16 mm, or between 13 mm and 15 mm. Furthermore, a width of the centermost aperture(s) 7*a*, 7*b* of the second area 6 can be smaller than a width of at least one another aperture 7*c*, 7*d*, of the second area 6 of the belt installation device. Thus, one belt installation device 1 can be used with different kind of belts 10 having different diameters and differently spaced apertures, and the belt 10 can be firmly attached to the belt installation device 1. In an advantageous example, a width 7*w* of those aperture(s) 7*c*, 7*d* of the second area 6, which area not the centermost apertures, can be at least 15 mm, for example between 15 mm and 40 mm, more preferably at least 20 mm, for example between 20 mm and 35 mm, and most preferably at least 22 mm, for example between 22 mm and 30 mm. Thus, thanks to the apertures of the second area of the belt installation device having said dimensions, one belt installation device can be used with different kinds of belts having different diameters and differently spaced attaching points 10*a*, such as apertures.

Advantageously, a length 7*h* of at least one aperture of the second area 6 of the belt installation device 1 is smaller than a width 7*w* of said aperture of the second area 6 of the belt installation device 1. The second area 6 of the belt installation device can have at least one aperture 7, such as from one to six apertures, more preferably at least two apertures, such as from two to four apertures, wherein the width 7*w* of said aperture is at least 1.3 times, for example from 1.4 to 4.0 times, more preferably from 1.4 times to 3.0 times the length 7*h* of said aperture.

The second area 6 of the belt installing device 1 can have, in a width direction, two adjacent apertures 7 of the second area 6, wherein center points of said apertures 7 are at least 30 mm from each other, for example between 30 mm and 120 mm, more preferably at least 40 mm from each other, such as between 40 mm and 100 mm from each other and most preferably at least 50 mm from each other, such as between 50 mm and 80 mm from each other. Advantageously, all apertures 7 of the second area are located so that each distance between center points of two adjacent apertures 7 of the second area 6, is at least 30 mm, for example between 30 mm and 120 mm, more preferably at least 40 mm, such as between 40 mm and 100 mm and most preferably at least 50 mm, such as between 50 mm and 80 mm. Thus, the belt may be secured firmly to the belt installation device by using said apertures having said distances.

The second area 6 of the belt installation device can have at least one such aperture 7, 7*a*, 7*b*, 7*c*, 7*d*, for example two to four apertures, wherein the center point(s) of said aperture(s) 7, 7*a*, 7*b*, 7*c*, 7*d* is/are located at least 14 mm, such as from 14 mm to 30 mm from the nearest edge of the belt installation device, measured in a length direction 1*h*, more preferably the center point(s) of said aperture(s) 7, 7*a*, 7*b*, 7*c*, 7*d* is/are located at least 15 mm, such as from 15 mm to 25 mm and most preferably at least 16 mm, such as from 16 mm to 20 mm from the nearest edge of the belt installation device, measured in a length direction 1*h*. The technical effect is that the belt installation device 1 may have good strength properties and, further, the belt installation device may be attached easily to the belt 10 to be installed.

As already discussed, the belt installation device 1 can comprise two layers 1*a*, 1*b*, i.e., a first layer 1*a* of the belt installation device and a second layer 1*b* of the belt installation device. Advantageously, said layers of the belt installation device have same dimensions or substantially same dimensions with each other. Therefore, strength properties as well as dimensional stability of the belt installation device 1 can be at a high level.

Figure 4B:
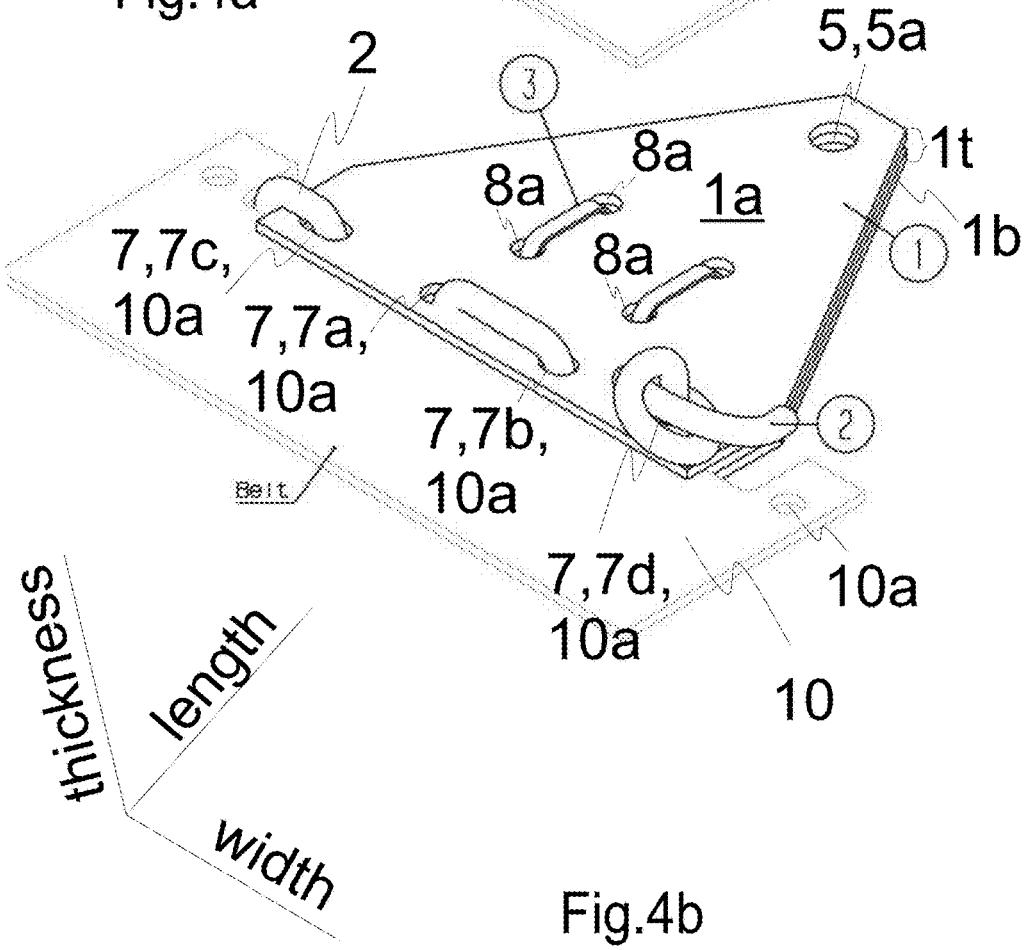
FIG. 4*b* illustrates a perspective view of an arrangement comprising the belt installation device and belt attaching means, showing the first layer of the belt installation device on top of the second layer.

Advantageously, at least the second area 6 of the belt installation device 1 comprises two layers. Furthermore, advantageously said two layers are not attached to each other on the second area 6 of the belt installation device, hence, it is possible to secure the belt 10 to be installed between said two layers 1*a*, 1*b* of the belt installation device 1 as shown in FIGS. 4*a*-4*b*. Thus, the belt to be installed can be fastened to the belt installation device 1 firmly and an excessive bending of the belt installing device 1 during the installation process can be avoided. Therefore, the installation process of the belt 10 can be easier than with a belt installation device 1 having only one layer.

Figures 3A, 3B:
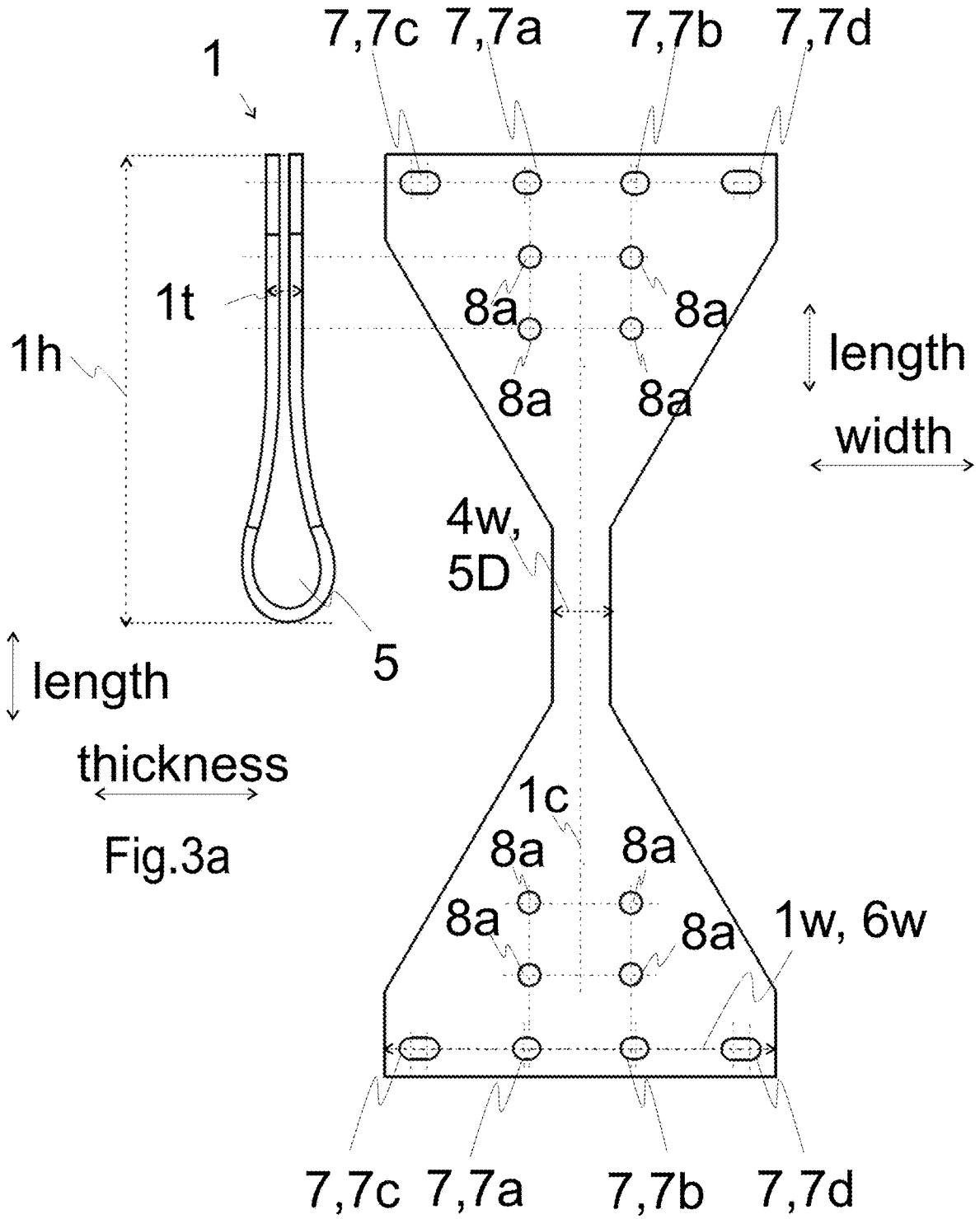
FIG. 3*a* illustrates a belt installation device, examined in a second direction, perpendicular to the first direction.
FIG. 3*b* illustrates a preform of the belt installation device, examined in a first direction, wherein the belt installation device will be formed by folding the preform, the belt installation device having two layers after the preform is folded into-the-belt installation device (shown in FIG. 3*a*)

The first layer 1*a* and the second layer 1*b* of the belt installation device 1 can be formed from separate pieces, which are preferably attached to each other (shown in FIGS. 4*a* and 4*b*), or they can be formed from one piece by folding (shown in FIGS. 3*a* and 3*b*).

If the first layer 1*a* of the belt installation device and the second layer 1*b* of the belt installation device are formed from one piece by folding, the attaching point 5 of the first area of the belt installation device can comprise an aperture, and/or the attaching point can be formed by the folded loop (shown in FIG. 3*a*).

If the first layer of the belt installation device and the second layer of the belt installation device were separated pieces, which are attached to each other as layers of the belt installation device, the attaching point 5 of the first area of the belt installation device preferably comprises or consists of an aperture (shown in FIGS. 4*a* to 4*b*).

Advantageously, the first layer of the belt installation device 1*a* and the second layer of the belt installation device 1*b* were separated pieces, which are attached to each other. Thus, the belt installation device 1 can be easier to manufacture and use.

The first layer 1*a* of the belt installation device 1 and the second layer 1*b* of the belt installation device 1 can be attached to each other at least partially. Advantageously, the first layer 1*a* and the second layer 1*b* of the belt installation device 1 are attached to each other partially on the central area 8 of the belt installation device.

The first layer 1*a* and the second layer 1*b* can be attached to each other on the central area 8 of the belt installation device 1, for example, by using internal attaching means 3. Preferably, the first layer 1*a* and the second layer 1*b* of the belt installation device are not attached to each other at least on the second area 6 of the belt installation device. Therefore, it is possible to secure the belt to be installed between first layer 1*a* of the belt installation device and the second layer 1*b* of the belt installation device as shown in FIGS. 4*a*-4*b*. Thus, the belt 10 to be installed can be fastened to the belt installation device 1 firmly. Furthermore, excessive, uncontrolled bending of the belt installing device during the installation process can be avoided. Moreover, the installation process can be easier controlled by using the first layer 1*a* and the second layer 1*b* having the belt 10 between said layers than with a solution wherein the belt is not placed between said layers of the belt installation device.

Advantageously, the central area 8 of the belt installation device comprises aperture(s) 8*a* of the central area of the belt installation device (shown in FIGS. 2-5). Preferably, the central area 8 of the belt installation device comprises at least three apertures, such as from three to eight apertures, more preferably at least four apertures 8*a*, such as from four to six apertures 8*a* of the central area of the belt installation device. Said apertures 8*a* of the central area of the belt installation device can be used to attach the first layer 1*a* and the second layer 1*b* firmly to each other on the central area 8 of the belt installation device.

The first layer 1*a* and the second layer 1*b* of the belt installation device can be fastened to each other by using internal attaching means 3 of the belt installation device 1. The internal attaching means 3 can comprise an adhesive, and/or
a cable tie, and/or
a rope.

Alternatively, or in addition, the first layer and the second layer of the belt installation device can be fastened to each other by melting, and/or
gluing, and/or
using metal clip(s) and/or polymer clip(s), or
vulcanizing said layers.

The belt installation device 1 can be removably attached to the belt 10, preferably to at least one aperture of said belt 10. Advantageously, the belt installation device 1 is attached removable to the belt 10 by using belt attaching means 2, such as a fastening rope.

The novel arrangement can comprise the belt installation device 1 and the fastening rope 2. The fastening rope 2 has a first end and a second end. Advantageously, a diameter of the fastening rope 2 is between 10 and 15 mm, more preferably at least 11 mm, such as between 11 and 14 mm, and most preferably at least 12 mm, for example between 12 mm and 13 mm. The technical advantage of said diameter of the fastening rope is that the belt 10 can be secured to the belt installation device 1 in a safety way, hence, a risk of damaging the belt can be decreased. Advantageously, the novel arrangement comprises 1 to 2 fastening ropes, most preferably exactly one fastening rope 2.

The fastening rope 2 should be a material that has good strength properties but is not easily damaging the belt during the installation process. The fastening rope 2 can comprise or be made of the following materials:

metal, and/or
nylon, and/or
polyethylene (PE), and/or
polyester.

Advantageously, the fastening rope 2 comprises at least 50 wt. % of these material(s), calculated from dry weight of the fastening rope 2. These materials are not easily damaging the belt but have good strength properties.

Advantageously, the fastening rope 2 comprises or consists of nylon. The amount of nylon is preferably at least 50 wt. %, more preferably at least 70 wt. % calculated from dry weight of the fastening rope 2. The fastening rope 2 can have two parts: a sheath and a core. The sheath is an outer layer of the rope, which is a protective layer. The sheath can comprise or consists of, for example, nylon fibers. The core of the rope is the inner part of the rope. The core can be made up, for example, tightly packed nylon strings.

The aperture(s) 7,7*a*,7*b*,7*c*,7*d* of the second area 6 of the belt installation device are advantageously located parallel or substantially parallel to the width 6*w* direction of the second area 6 of the belt installation device 1.

At least one aperture, more preferably at least two apertures, such as from two to six apertures, more preferably at least three apertures, such as from three to five apertures, and most preferably at least four apertures, such as four or six apertures of the second area 6 of the belt installation device 1 can be used to secure the attaching points 10*a* of the belt 10 to the apertures 7,7*a*,7*b*,7*c*,7*d* of the second area 6 of the belt installation device.

During the installation process, each aperture 7,7*a*,7*b*,7*c*, 7*d* of the second area 6 of the belt installation device 1 used for the fastening, can be located on one attaching point 10*a* of the belt 10. Preferably the attaching points 10*a* of the belt 10, in a form of apertures, are placed between the first layer 1*a* and the second layer 1*b* of the belt installation device, in order to provide good strength properties and safeness of the individuals during the installation process of the belt (shown in FIG. 6*b*). Advantageously, the fastening rope 2 is used to secure the belt 10 to the belt installation device 1.

Figure 7:
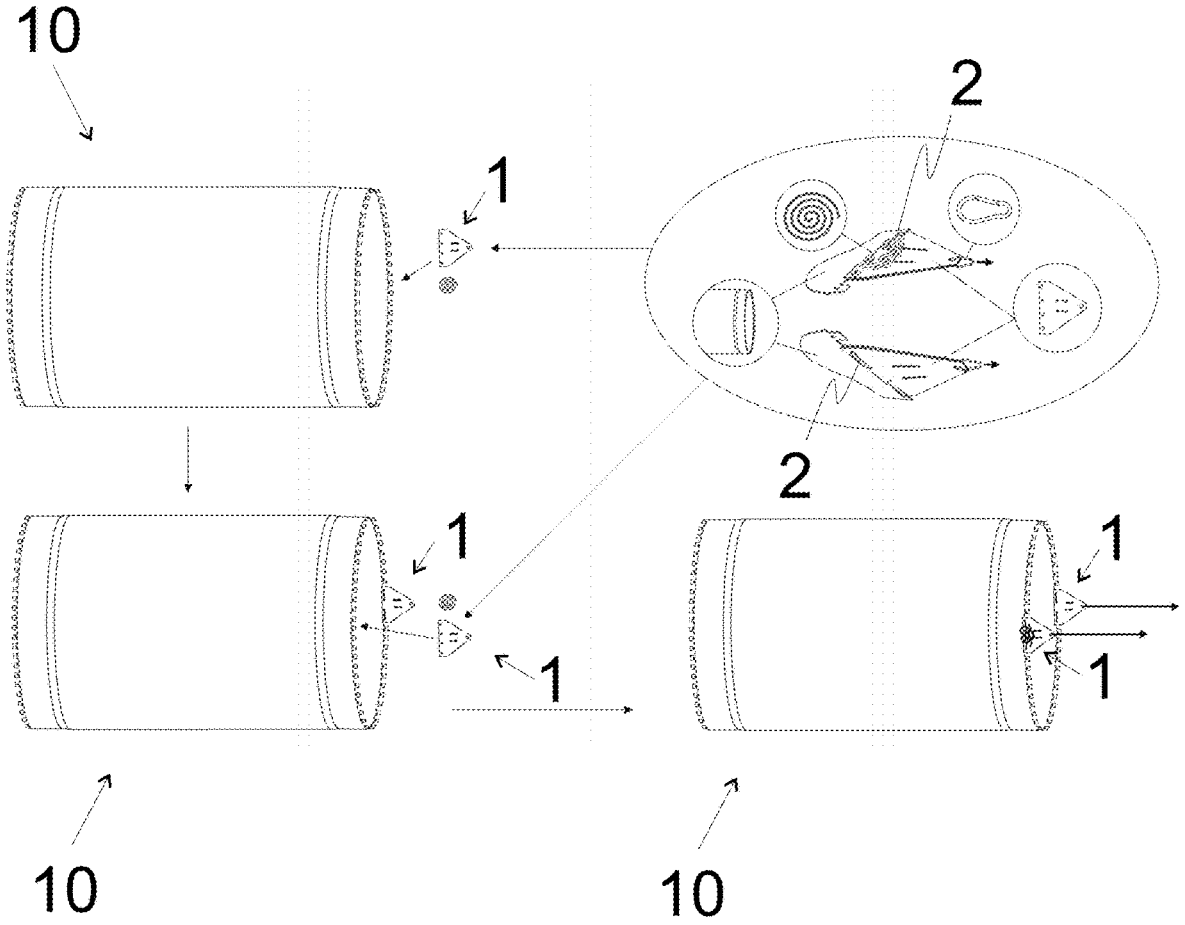
FIG. 7 illustrates an example, wherein two belt installation devices are used to install a belt.

The belt 10 can comprise several attaching points 10*a*, such as apertures. Advantageously, the belt 10 used for the installation method comprises in a range of three to ninety attaching points, such as apertures, from which one to six is preferably selected for each belt installation device used for the installation method. Advantageously, from two to four belt installation devices are used for the installation method, hence, advantageously four to twenty-four attaching points, more preferably eight to twelve attaching points of the belt is used during the installation process of the belt. FIG. 7 illustrates an advantageous example, wherein two belt installation devices are used for the installation method.

The attaching points 10*a* of the belts can be apertures having a diameter in a range of 10 to 20 mm, for example from 12 mm to 16 mm. The diameter of the belt attaching means 2, such as the fastening rope, can be determined so that it will fasten the belt 10 to the belt installation device 1 firmly.

For the installation method, the belt 10 can be secured to the belt installation device 1, and the belt installation device 1 can be secured to pulling member, such as a pull rope. Advantageously, the belt 10 is secured to the second area 6 of the belt installation device 1, and the pull rope is secured to the first area 4 of the belt installation device 1. Therefore, it is possible to install the belt by pulling the pulling member, such as the pull rope (shown in FIG. 7).

The fastening rope 2 can be passed through the apertures of the belt 10 and the belt installation device 1 used for securing the belt to the installation device so that the fastening rope 2 follows the width direction of the belt installation device. Advantageously, the fastening rope 2 is first passed through the first apertures of the belt installation device 1 and the belt. The first aperture of the belt installation device is the aperture 7*d*, 7*c* which is the closest of the side edges of the belt installation device. Thus, the fastening rope 2 is first passed through the first apertures of the belt installation device 1 and the belt, then through an adjacent aperture, then through an adjacent aperture which has not been used yet, and so on, until the last aperture has been used, after which the fastening rope is finally secured. The secured fastening rope 2 is shown in FIGS. 4*a*, 4*b*, 6*a* and 7.

An installing method for installing a belt 10 onto a paper, board or pulp machine can include

- providing a belt 10 having at least one attaching point, preferably plurality of attaching points, each attaching point preferably being an aperture,
- providing a belt installation device 1 having
  - a first area 4 comprising an attaching point 5 for attaching the belt installation device to a pulling member, such as a pull rope,
  - a second area 6 comprising at least one aperture 7, 7*a*, 7*b*, 7*c*, 7*d* for fastening the belt installation device (1) removably to the at least one attaching point (10*a*) of the belt (10), and
  - a central area (8), between the first area (4) and the second area (6),
- securing the belt 10 to the second area 6 of the belt installation device 1 by using said at least one aperture of the second area of the belt installation device,
- securing the pulling member to the attaching point 5 of the first area 4 of the belt installation device 1, and
- pulling the pulling member in a given direction in order to install the belt 10 onto a predetermined location of the paper, pulp, or board machine, wherein if a pulling force of the pull rope increases over a predetermined value, the method further comprises breaking the attaching point 5 of the first area 4 of the belt installation device to minimize damages of the belt.

The pulling member, such as a pull rope, are advantageously secured to the first attaching point 5 of the first area of the belt installation device 1. The first attaching point can be an aperture 5*a*. Said attaching point of the first area 4 of the belt installation device 1 is preferably located on the centerline 1*c* of the belt installation device 1.

The pulling member can be secured to the belt installation device 1 by any suitable means known by a skilled person. Advantageously, the pulling member comprises a pull rope. The pull rope can have good strength properties; hence, it can be particularly suitable for said purpose. The pull rope can be any kind of pull rope known by a skilled person, suitable for the purpose.

Figure 6B:
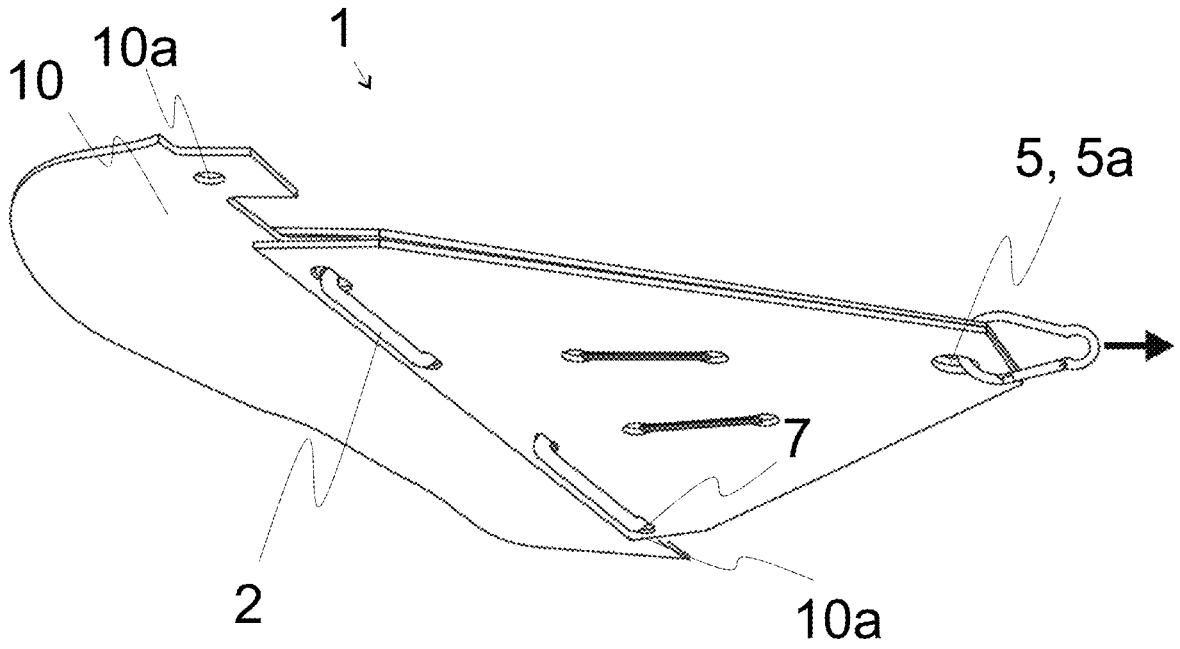
FIG. 6*b* illustrates a perspective view of a part of a belt and an arrangement comprising the belt installation device and belt attaching means.

Advantageously, the belt 10 is secured between the first side 1*a* and the second side 1*b* of the belt installation device 1 during the installation process of said belt 10 as shown in FIGS. 4*a*, 4*b* and 6*b*. Thus, the belt can be firmly secured to the belt installation device 1 by using attaching point(s) 10*a* of the belt 10.

The belt installation device 1 can be an effective way to install a belt to a paper, pulp or board machine by pulling the belt, for example, onto a shoe press of the machine.

The belt installation device(s) 1 can be attached to the belt 10 before the belt 10 is shipped to a paper, pulp or board mill. Advantageously, the belt installation device(s) 1 is/are attached to the belt 10 at a mill before or during the installation process of said belt and removed after the installation process. Thus, the belt installation device 1, which can be removably attached, can be reused at the mill for installing another belt 10.

The belt installation device can have smooth surfaces, or at least one surface of the belt installation device 1 may have, for example, several grooves, such as several parallel grooves on an outer surface(s) of the belt installation device.

Paper, pulp and board mills can use different kinds of belts having different diameters and different spacings between attaching points. The novel belt installation device can be designed to be suitable for many different kinds of belts. Thanks to the novel solution, the belt installation device can be used to prevent damage to the belt, hence, total costs relating to belts and installation processes of belts can be decreased.

Furthermore, thanks to the novel, improved solution, damaging of the attaching points 10*a* of the belt 10 can be minimized or avoided.

Moreover, thanks to the novel solution, there is no need for additional special tools, which may be expensive and/or difficult to use, but the belt installation device can be used, with its own attaching means. Moreover, the belt installation device can be substantially simple device, which can be quite easy to manufacture and use. Furthermore, the novel solution can improve safeness of individuals at a mill side during the installation process.

I claim:

1. A belt installation arrangement comprising at least two belt installation devices for installing a tubular belt onto a paper machine, pulp machine or board machine, each belt installation device comprising:

a flexible body having a first segment having portions defining an attaching point for attaching the belt installation device to a pulling member;

a second segment of the body which is wider than the first segment and which has portions defining at least one aperture for fastening the belt installation device removably to a belt, and a central segment of the body positioned between and connecting the first segment and the second segment, wherein when the pulling member is attached to the first segment attaching point, the pulling member applies a force of a selected pull strength between at least 300 kgf to 900 kgf without breaking the first segment at the attaching point, and wherein a force of greater than the selected pull strength applied to the first segment by the pulling member will break the first segment at the attaching point such that the pulling member detaches from the first segment, and wherein a bending axis is defined extending from the first segment to the second segment, and the body is bendable about the bending axis to have a radius of 800 mm; and wherein the at least two belt installation devices are positionable symmetrically around a perimeter of the tubular belt and are attached to attaching points of the tubular belt at a mill side of the paper machine, pulp machine or board machine, for installation of the tubular belt by pulling the tubular belt in a cross-machine direction.

2. The belt installation arrangement of claim 1 further comprising:

a pulling member which is a fastening rope of 10-15 mm diameter which is connected to the first segment at the attaching point, and a belt having portions defining at least one belt attaching point, and wherein the belt is fastened to the belt installation device such that said at least one attaching point of the belt is fastened between a first layer and a second layer of the belt installation device.

3. The belt installation arrangement of claim 1 wherein the body of each belt installation device is comprised of two superposed layers of material, and wherein the second segment at least one aperture for fastening the body removably to a belt comprises at least one aperture in each of the two superposed layers, said belt being receivable between said two superposed layers.

4. The belt installation arrangement of claim 3 wherein the body first layer is attached to the second layer at the body central segment, the attachment being by an adhesive, a cable tie, a rope, metal clip(s), polymer clip(s) by melting at least partly surfaces of said superposed layers which facing each other, and/or vulcanizing said layers, the attachment leaving the layers unconnected at the body segment to allow a belt to be received therebetween.

5. The belt installation arrangement of claim 1 wherein in each belt installation device the attaching point of the body first segment comprises an aperture.

6. The belt installation arrangement of claim 1, wherein the selected pull strength is in a range of 400-600 kgf.

7. The belt installation arrangement of claim 1 wherein the body of each belt installation device has a length direction extending from the first segment to the second segment, and a width direction perpendicular to the length direction, and a thickness perpendicular to both the length direction and the width direction, and wherein the body has a length of 150-400 mm, a thickness of at least 4 mm and equal or less than 40 mm, and a width determined on a widest part of the belt installation device of 150-550 mm.

8. The belt installation arrangement of claim 1 wherein the body of each belt installation device is of polyamide, and/or polyester, and/or polyethylene, and/or silicone, and/or polyurethane, and/or natural rubber (NR), and/or synthetic rubber (SR), and/or polytetrafluoroethylene (PTFE).

9. The belt installation arrangement of claim 1 wherein the body material is comprised of polyurethane, the amount of the polyurethane being at least 50 percent of the total weight of the belt installation device.

10. The belt installation arrangement of claim 1 wherein in each belt installation device the body first segment attaching point comprises an aperture having a width of 10-40 mm.

11. The belt installation arrangement of claim 1 wherein in each belt installation device the body second segment at least one aperture has a length of 10-18 mm, and the attaching point of the first body segment comprises an aperture having a width of 10-40 mm.

12. The belt installation arrangement of claim 1 wherein the body of each belt installation device has a length direction extending from the first segment to the second segment, and a width direction perpendicular to the length direction, and wherein the at least one aperture of the body second segment has a width at least 1.3 to 4.0 times a length of said aperture.

13. The belt installation arrangement of claim 1 wherein the body of each belt installation device has a length direction extending from the first segment to the second segment, and a width direction perpendicular to the length direction, and wherein the at least one aperture of the body second segment comprises a centermost aperture and at least one other aperture defined by portions of the body second segment, and the centermost aperture has a width that is smaller than a width of the at least one other aperture.

14. The belt installation arrangement of claim 8 wherein the amount of said body polyamide, and/or polyester, and/or polyethylene, and/or silicone, and/or polyurethane, and/or natural rubber (NR), and/or synthetic rubber (SR), and/or polytetrafluoroethylene (PTFE) is at least 50 wt. %, calculated of total weight of the belt installation device.

* * * * *